United States Patent [19]

Isobe et al.

[11] Patent Number: 4,688,955

[45] Date of Patent: Aug. 25, 1987

[54] AUTOMATIC RIBBON POSITIONING SERIAL PRINTER

[75] Inventors: Minoru Isobe; Shuichi Imai; Toru Hiroki, all of Tokyo; Tadasi Kodama, Sakura; Waturu Ohara, Yokosuka, all of Japan

[73] Assignees: Oki Electric Industry Co., Ltd.; Nippon Telegraph & Telephone Public Corporation, both of Tokyo, Japan

[21] Appl. No.: 418,033

[22] Filed: Sep. 14, 1982

Related U.S. Application Data

[63] Continuation of Ser. No. 187,706, Sep. 16, 1980, abandoned.

[30] Foreign Application Priority Data

Sep. 28, 1979 [JP] Japan ..... 54-123978

[51] Int. Cl.[4] ..... B41J 35/06

[52] U.S. Cl. ..... 400/248; 400/174; 400/196; 400/233

[58] Field of Search ..... 400/124, 194–196.1, 400/174, 207–208.1, 248, 248.1, 233; 226/151, 165, 166, 167

[56] References Cited

U.S. PATENT DOCUMENTS

| | | | |
|---|---|---|---|
| 2,246,969 | 6/1941 | Antrim | 226/151 X |
| 3,726,381 | 4/1973 | Murphy | 400/248 X |
| 3,758,012 | 9/1973 | Bonner et al. | 226/168 |
| 3,974,906 | 8/1976 | Lee et al. | 400/196.1 |
| 3,977,512 | 8/1976 | Teagarden et al. | 400/124 X |
| 4,053,040 | 10/1977 | McGourty | 400/124 X |
| 4,062,436 | 12/1977 | Kondur et al. | 400/124 |
| 4,279,518 | 7/1981 | Blomquist et al. | 400/124 |

FOREIGN PATENT DOCUMENTS

| | | | |
|---|---|---|---|
| 1454633 | 8/1966 | France | 226/165 |

OTHER PUBLICATIONS

*IBM Tech. Disc. Bulletin,* by E. N. Dials et al., vol. 23, No. 4, Sep. 1980, pp. 1517–1520.

*Primary Examiner*—Paul T. Sewell

*Attorney, Agent, or Firm*—Armstrong, Nikaido, Marmelstein & Kubovcik

[57] ABSTRACT

A serial printer having a platen (5) and a carriage (4) having a printer head (6) with a plurality of aligned print needles close to the platen (5) for mosaic printing is disclosed. According to the present invention, an ink ribbon is in a detachable ribbon cartridge (3) under tension, and the printer head (6) has a smooth slope at the top of the head (5) that slopes towards the platen, thus, when the ribbon cartridge is put on the printer, the ink ribbon is temporarily twisted at the top of the slope on the head (6), and by swinging the printer head (5) a few times along the platen (6), the ink ribbon (1) at the top of the slope slides down along the slope into the narrow gap between the head (6) and the platen (6), and thus, the ink ribbon (1) is positioned in front of the print needles.

5 Claims, 10 Drawing Figures

AUTOMATIC RIBBON POSITIONING SERIAL PRINTER

This is a continuation of application Ser. No. 187,706, filed Sept. 16, 1980, now abandoned.

BACKGROUND OF THE INVENTION

The present invention relates to the structure of a serial printer, which supplies a fresh ink ribbon as the printer head travels along the platen of the printer, in particular, relates to such a serial printer which utilizes a mosaic printer head.

A mosaic printer head generates a character pattern with a plurality of dots selectively printed on a paper, and those dots are printed either by a thermal printer head which prints by changing the color of a treated thermal paper by heating a small area on that paper, or a needle type printer head which prints dots by striking an untreated paper with a printing needle through an ink ribbon. The example of the latter needle type printer head is shown in U.S. Pat. No. 3,896,918. Alternatively, the present applicant filed the improvement of a needle type printer head in U.S. Pat. No. 147,106 and West Germany patent application P 30 17 903.4.

In a serial printer utilizing a mosaic printer head, a printer head and a printing paper are positioned very close to each other, and an ink ribbon must be threaded in that narrow slit between paper and printer head as shown in FIG. 1, in which the reference numeral 1 is an ink ribbon, 5 is a platen, 6 is a printer head, 8 is a ribbon protector which is essentially a U-shaped thin plate provided to prevent marking an undesirable portion of a paper with an ink ribbon, and 13 is a paper. The printer head 6 has a plurality of printing needles which are selectively actuated and strike a paper through a window between a pair of arms of said U-shaped ribbon protector 8 and the ink ribbon 13 to print a desired pattern.

In such a needle type serial printer, when an ink ribbon is mounted, that ink ribbon must be threaded through the narrow slit between a ribbon protector and a printer head, and a one-way feed mechanism (not shown in FIG. 1) which feeds an ink ribbon in the predetermined direction, and further the path of an ink ribbon is not straight but is folded or curved. Therefore, it takes long time to manually mount an ink ribbon through those paths and involves much trouble, further, there is a disadvantage in that the operator's fingers become dirty when threading the ink ribbon.

Alternatively, the printer head 6 can be temporarily removed from the platen to provide a wide area between the printer head and the platen to thread the ink ribbon. However, the means for removing a printer head is rather complicated, and is not suitable for a small and simple serial printer.

SUMMARY OF THE INVENTION

It is an object of the present invention to overcome the disadvantages and limitations of prior printers by providing a new and improved serial printer.

It is also an object of the present invention to provide a serial printer in which an ink ribbon is easily threaded.

The above and other objects of the present invention are attained by a serial printer comprising; a housing; a platen fixed on the housing; a guide shaft extending parallel to that platen; a carriage having a printer head with a plurality of print needles for mosaic printing; and a one way feed mechanism for providing a different amount of friction to an ink ribbon depending upon the direction of movement of the carriage, said carriage travelling along said guide shaft driven by a wire; a ribbon cartrige having a U-shaped cover plate and side walls surrounding the cover plate, an endless ink ribbon running along each arm of the U-shaped cover plate and bridging the ends of pair of arms of said U-shaped cover plate, means for refreshing the ink ribbon by supplying fresh ink, and means for providing tension to the ink ribbon; said printer head being positioned close to the platen leaving a narrow gap, and the top of said printer head having a smooth slope so that the height of the printer head is lower towards the platen to let the ink ribbon slide down said slope into the gap between the platen and the printer head.

BRIEF DESCRIPTION OF THE DRAWINGS

The foregoing and other objects, features, and attendant advantages of the present invention will become better understood by means of the following description and accompanying drawings wherein.

DESCRIPTION OF THE PREFERRED EMBODIMENTS

Figure 1:
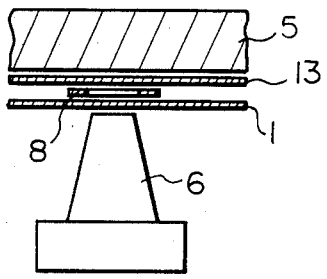
FIG. 1 shows the enlarged view of the portion of a printer head and an ink ribbon of a serial printer.
Figure 2:
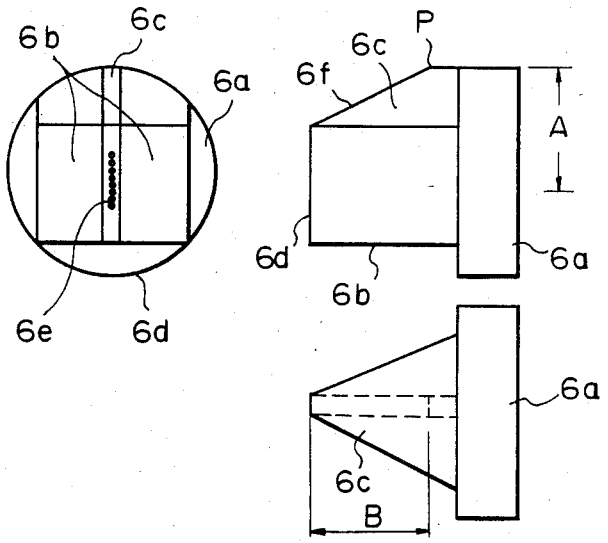
FIG. 2 shows a printer head according to the present invention.

FIG. 2 shows the appearance of the printer head 6 according to the present invention. The printer head 6 has the circular disk *6a* which includes means for actuating printing needles for printing mosaic characters, and a pyramid *6b* fixed at the center of the disk *6a*, and said pyramid includes a plurality of printing needles. At the front end *6d* of the pyramid *6b*, there are provided a plurality of printing needles *6e*, which are selectively actuated to strike a paper through an ink ribbon. A member *6c* is fixed on the pyramid *6b* so that the upper surface of the printer head as seen in the elevational view is slanted. The member *6c* is essentially triangular shaped, having the smooth slope *6f* so that the printer head is low at the front end of the same, and is high at the bottom of the same, i.e. the end fixed to disc *6a*, and the upper line between the front end and the bottom of the printer head is almost linear. The presence of the slanted member *6c* is one of the important features of the present invention. The housing and/or the member *6c* of the printer head 6 are made of plastic, and when the printer head 6 is positioned in front of the platen, the head 6 extends downward towards the platen due to the presence of the slope *6f*.

Figure 3A:
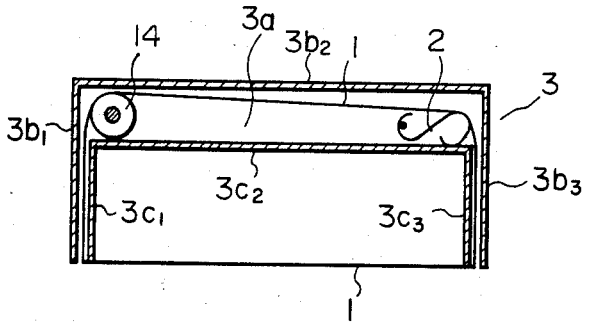
FIG. 3A shows a plan view of an ink ribbon cartridge according to the present invention.
Figure 3B:
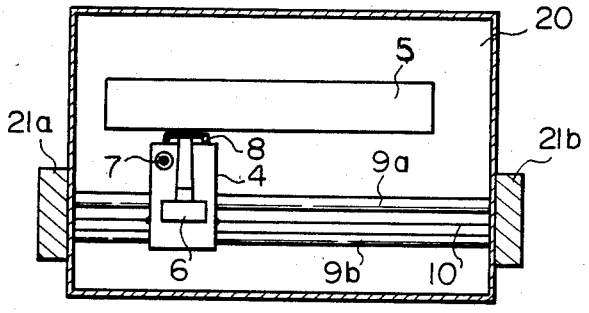
FIG. 3B shows a plan view of a serial printer which accepts the ink ribbon cartridge in FIG. 3A, FIGS. 4A, 4B, 4C and 4D show the steps that an ink ribbon is mounted in a serial printer.
Figure 5:
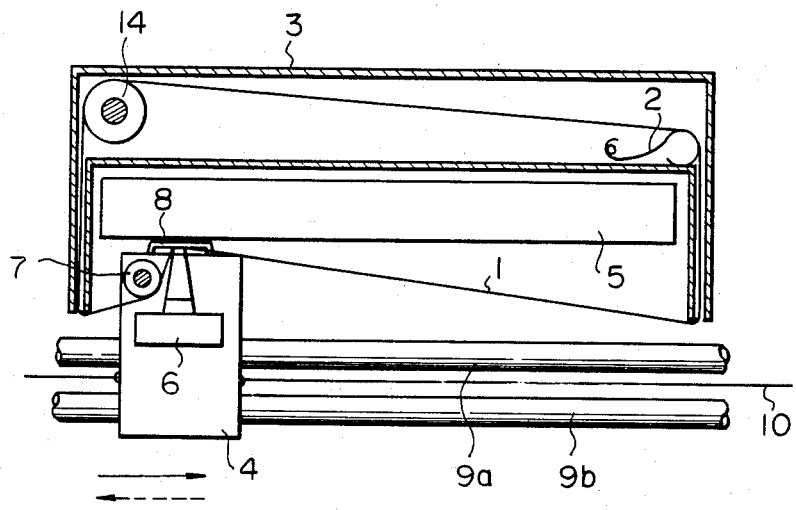
FIG. 5 shows a plan view of a serial printer in which an ink ribbon is mounted.

FIG. 3A shows the plan view of a ribbon cartridge, and FIG. 3B is the plan view of the serial printer in which a ribbon cartridge in FIG. 3A is to be mounted, and FIG. 5 shows the serial printer with a ribbon cartridge mounted.

The ribbon cartridge 3 has a U-shaped bottom cover plate 3*a*, the outer side walls 3*b*$_1$, 3*b*$_2$ and 3*b*$_3$, the inner side walls 3*c*$_1$, 3*c*$_2$ and 3*c*$_3$. Between the side walls 3*b*$_2$ and 3*c*$_2$, a relatively wide area is provided, and a relatively narrow slits are provided between the side walls 3*b*$_1$ and 3*c*$_1$, and between 3*b*$_3$ and 3*c*$_3$ as shown in FIG. 3A. That area and the slits or the arms of the U-shaped plate define part of the path of an ink ribbon. An ink refresher roller 14 which is made of porous material like sponge including liquid ink is provided on the bottom cover plate so that said roller can rotate around the axis of the same. Also a spring 2 is provided on said bottom cover plate 3*a* in order to provide tension to the ink ribbon. An ink ribbon 1 which is an endless tape runs through the tension spring 2, the refresher roller 14, the slit or arm between the walls 3*b*$_1$ and 3*c*$_1$, the open space, the slit or arm between the walls 3*b*$_3$ and 3*c*$_3$. The tension spring 2 forces the ink ribbon 1 towards the outer side wall 3*b*$_2$, and the ink ribbon 1 is mounted against that spring 2. Therefore, tension is provided to the ink ribbon 1 by said tension spring. Said ribbon cartridge 3 is covered with an upper cover plate (not shown).

In FIG. 3B, the serial printer has a housing 20 which has a side wall around the same, and said side wall can engage with the side wall of the ribbon cartridge of FIG. 3A. A platen 5 is provided on the housing, and a pair of guide shafts 9*a* and 9*b* are provided parallel to said platen 5. A carriage 4 travels along said guide shafts 9*a* and 9*b* by being pulled by a wire 10. The wire 10 is pulled by moving means 21*a* and 21*b* so that the carriage 4 travels from the left to the right, and from the right to the left, along the guide shafts. The means 21*a* and 21*b* have a motor (not shown). The carriage 4 has a printer head 6 having a plurality of print needles, and a one-way feed mechanism 7 which applies friction to the ink ribbon 1 depending upon the direction of movement of the carriage 4. That is to say, the friction between the mechanism 7 and the ink ribbon 1 is small when the carriage 4 travels from left to right, and so the ink ribbon 1 stops during the movement of the carriage 4 in that direction, and therefore, a fresh portion of the ink ribbon 1 appears as the printer head 6 travels together with the carriage 4. On the other hand, the friction between the mechanism 7 and the ink ribbon 1 is large when the carriage 4 travels from right to left, and so the ink ribbon 1 travels in the clockwise direction when the carriage 4 returns is that direction, therefore, a fresh ink ribbon is provided on the whole length of each printing line after the preceding line is printed.

A print paper (not shown) is fed between the platen 5 and the printer head 6.

The length of the arms of the ribbon cartridge 3 is determined so that the ink ribbon bridging the ends of the arms passes above the slope 6*f* of the printer head 6, upon engaging the ribbon cartridge with the printer.

Now, the positioning operation of the ink ribbon 1 on the printer is described. When the ink ribbon 1 is positioned on the printer, the ink ribbon 1 runs from the left end of the cartridge, through the one-way feed mechanism 7, and the front end of the printer head 6, to the right end of the cartridge, as shown in FIG. 5. And it should be appreciated that the ink ribbon 1 must be curved or folded at the mechanism 7 and the printer head 6 in order to give the proper pressure by the ink ribbon to the printer head 6 and the mechanism 7.

Figure 4A:
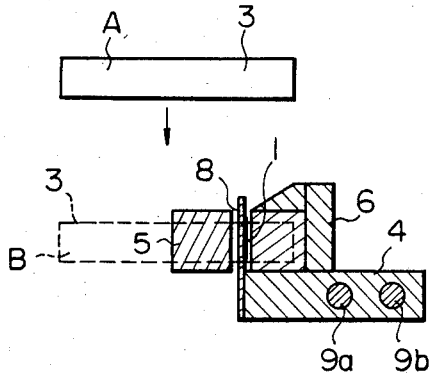

The ribbon cartridge 3 is first put at the position A just above the printer as shown in FIG. 4A, then, that cartridge 3 is lowered and put on the printer as shown in the position B of FIG. 4A. When the cartridge 3 is positioned at the position B, the side wall of the cartridge 3 is engaged with the wall of the housing of the printer, and thus, the cartridge 3 is fixed to the housing of the printer.

The ribbon 1 is positioned between the printer head 6 and the ribbon protector 8 as shown in FIG. 5 during the operation in which cartridge 3 is being put on the printer as described below.

Figure 4B:
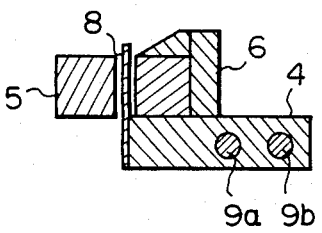
Figure 4C:
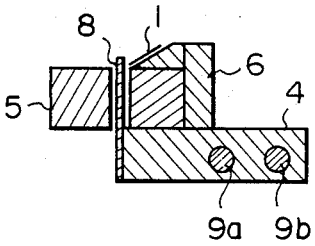

When the cartridge 3 is at the position A of FIG. 4A, the ribbon 1 is above the printer as shown in FIG. 4B. Next, when the cartridge 3 is lowered to the position B of FIG. 4A, the ribbon 1 will be put on the slope of the printer head 6 as shown in FIG. 4C, and the ink ribbon 1 is twisted by the angle of slope on the slope 6*f* of the head 6.

Figure 4D:
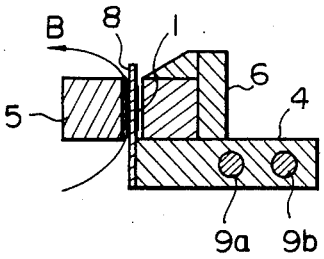

Next, the carriage 4 is moved in both directions along the guide shafts 9*a* and 9*b*. It should be appreciated in this case that the spring 2 provides tension to the ink ribbon 1, therefore, the ink ribbon 1 tends to be the shortest, and to recover the twist. Accordingly, as the carriage 4 is swung along the guide shafts, the ink ribbon 1 slips down along the slope 6*f* of the slanted member 6*c* of the printer head 6, and finally, the ink ribbon 1 is positioned in front of the printing needles as shown in FIG. 4D within one or several swings of the carriage 4. The one way feed mechanism 7 is provided at the left of the printer head 6 on the carriage 4. Therefore, when the ink ribbon 1 is positioned in front of the printing needles, the ink ribbon 1 runs (see FIG. 5) from the left end of the ribbon cartridge 3, through the right side of the one way feed mechanism 7, the printing needles of the printer head 6, to the right end of the ribbon cartridge 3. And since the front end 6*d* of the printer head 6 is positioned inside of the ribbon path as shown in FIG. 5, the ribbon runs in a zigzag fashion, and the ribbon 1 touches with the printer head 6 with the correct amount of pressure.

The surface of the slope 6*f* is smooth enough to provide a small amount of friction between that slope 6*f* and the ink ribbon 1. Therefore, when the carriage 4 is manually swung along the guide shafts for positioning the ink ribbon 1 in front of the print needles, the ink ribbon does not rotate or move in the longitudinal direction, since the friction between the ink ribbon and the spring 2 and between the ink ribbon and the ink refresher roller 14 are larger than the friction between the ink ribbon and the slope 6*f*.

According to the preferred embodiment, the angle between the slope and the horizontal plane is more than 30 degrees, and is preferably 45 degrees, and the tension of an ink ribbon is 100–200 gr. After the ink ribbon 1 is positioned in front of the print needles as shown in FIG. 4D and FIG. 5, a print paper 13 is mounted between the platen 5 and the ribbon protector 8 as shown in FIG. 4D.

In a printing operation, the carriage 4 travels along the guide shafts from the left end to the right end as shown by the solid arrow in FIG. 5, and the print needles print character patterns on the paper 13. In that travelling of the carriage 4, the friction of the one way feed mechanism 7 is less for the ink ribbon, and therefore, the ink ribbon 1 does not move with the carriage 4, and thus, a fresh portion of the ink ribbon appears as the printer head travels to provide clearer printing. On the other hand, when the carriage returns from the right end to the left end as shown by the dotted arrow in FIG. 5, the friction between the one way feed mechanism and the ink ribbon 1 is larger, and therefore, the ink ribbon 1 travels as the printer head 6 returns in the direction of the dotted arrow, then, the fresh ink ribbon is provided for the next print line. The ink ribbon 1 is refreshed when that ink ribbon 1 passes the ink refresher roller 14. As mentioned, the one way feed mechanism 7 functions to provide a minimal amount of friction to an ink ribbon when the carriage 4 moves in the right direction, and provides larger amount of friction to an ink ribbon when the carriage 4 moves in the left direction.

Figure 6:
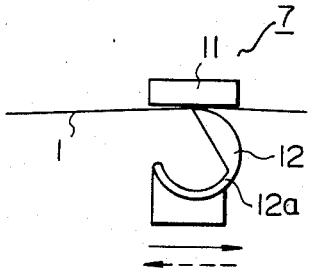
FIG. 6 shows the embodiment of one-way feed mechanism of an ink ribbon according to the present invention.

FIG. 6 is the embodiment of the one way feed mechanism 7. The mechanism 7 has the first flat member 11 fixed on the carriage 4, and the second half circular member 12 which is fixed on the carriage 4 so that said member 12 may pivot around the axis 12*a*. Those members 11 and 12*a* are made of plastics. When the carriage 4 together with the one way feed mechanism 7 moves in the direction shown by the solid arrow in FIG. 6, the curved surface of the second member 12 pushing the ink ribbon 1 to the first fixed member 11 tends to pivot in the anti-clockwise direction and tends to separate from that member 11, and therefore, the friction between the curved surface and the ink ribbon 1 is small, and the ink ribbon 1 slips and does not move with the carriage 4. On the other hand, when the carriage 4 together with the one way feed mechanism 7 returns in the direction as shown by the dotted arrow, the second member 12 pivots in the clockwise direction and the extreme sharp edge of the second member 12 pushes the ink ribbon 1 against the first fixed member 11. Therefore, the larger amount friction is provided to the ink ribbon, and so, the ink ribbon 1 follows the carriage 4 when the same returns in the direction of the dotted arrow. Preferably, the top of the second member 12 is slanted like the top of the printer head 6 so that an ink ribbon 1 is easily positioned between the first and the second members.

As mentioned above in detail, the present serial printer has a ribbon cartridge which provides a tensioned ink ribbon, and a printer head with the top slanted fixed close to a platen, an ink ribbon is easily positioned between a platen and a printer head merely by putting the ribbon cartridge on the printer and swinging a carriage one or several times. Thus, the structure of the printer is simple, and the carriage does not need to move back to provide a wide area between the platen and the carriage for positioning an ink ribbon, and further, an ink ribbon can be positioned without having the operator's hands soiled.

From the foregoing, it will now be apparent that a new and improved serial printer has been disclosed. It should be understood of course that the embodiments disclosed are merely illustrative and are not intended to limit the scope of the invention. Reference should be made to the appended claims, therefore, rather than the specification as indicating the scope of the invention.

What is claimed is:

1. A serial printer comprising:

a housing having a platen and a guide means fixed thereto, said guide means being disposed parallel to said platen;

a carriage mounted on said guide means for lateral translational movement parallel to said platen and carrying a printing head positioned close to said platen;

a ribbon cartridge containing a tensioned endless ink ribbon positionable in said housing and so arranged that, when positioned in said housing said ribbon extends across said platen;

said printing head being formed with a smooth slope on its upper surface extending downwardly toward said platen, whereby the positioning of said ribbon cartridge in said housing will initially cause said ribbon to rest on said sloping upper surface of said printing head under tension so that lateral translational movement of said carriage will cause said ribbon to slide down said upper sloping surface of said printing head and position itself between said printing head and said platen.

2. A serial printer as claimed in claim 1 wherein the slope of said upper surface of said printing head is greater than 30 degrees from the horizontal.

3. A serial printer as claimed in claim 2 wherein said slope is 45 degrees.

4. A serial printer as claimed in claim 1 wherein said upper surface of said printing head has a slope greater than 30 degrees from the horizontal and the ribbon tension is between 100 and 200 grams.

5. A serial printer comprising a housing containing a platen and a pair of guide shafts fixed thereto, said guide shafts extending parallel to said platen;

a carriage mounted for lateral translational movement on said guide shafts and carrying a printing head disposed in close proximity to said platen, said printing head being formed so that its upper surface slopes downwardly toward said platen;

a ribbon cartridge containing a ribbon under tension, said cartridge being positionable in said housing so that said ribbon extends across said platen and initially rests upon said upper surface of said printing head; and means for laterally moving said cartridge; whereby said lateral translational movement and said tension will cause said ribbon to slide down said sloping upper surface of said printing head and to automatically position itself between said printing head and said platen.

* * * * *